US005984605A

United States Patent [19]

Young

[11] Patent Number: 5,984,605

[45] **Date of Patent: *Nov. 16, 1999**

[54] PANEL LIFTING APPARATUS

[76] Inventor: Roland O. Young, R.R. #1, Box 138, Grand Forks, N. Dak. 58201

[ * ] Notice: This patent issued on a continued prosecution application filed under 37 CFR 1.53(d), and is subject to the twenty year patent term provisions of 35 U.S.C. 154(a)(2).

[21] Appl. No.: 08/958,725

[22] Filed: Oct. 23, 1997

Related U.S. Application Data

[60] Provisional application No. 60/029,489, Oct. 28, 1996.

[51] Int. Cl.[6] ..... E04G 21/14

[52] U.S. Cl. ..... 414/11; 414/507; 52/749

[58] Field of Search ..... 414/11, 10, 507; 280/47.34; 52/749

[56] References Cited

U.S. PATENT DOCUMENTS

| | | | |
|---|---|---|---|
| 2,815,132 | 2/1957 | Stone | 414/11 |
| 3,223,199 | 12/1965 | Schwehr | 414/11 |
| 3,382,988 | 5/1968 | O'Reilly | 414/11 |
| 5,700,123 | 12/1997 | Rokash et al. | 414/11 |

*Primary Examiner*—Karen M. Young
*Assistant Examiner*—Gregory A. Morse
*Attorney, Agent, or Firm*—Robert E. Kleve

[57] ABSTRACT

The invention comprises a panel lift apparatus for detachably mounting to a conventional drywall lifter for raising a drywall panel, from immediately adjacent the ground, to the lifting arms of the lifter for transfer of the panel to the lifting arms of the lifter. The apparatus has a main frame for attachment to the main frame of the lifter, with a pivotally mounted channel member pivotally mounted for pivoting adjacent the lifter for storage, and pivoted to a spaced away position for operation. The channel member has a lifting plate for movement down along the channel to a position immediately adjacent the ground for receiving a drywall panel thereon. A cable is attached to the lifting plate at its one end and a drum at its other end and a wheel is mounted to the drum to rotate the drum to wind the cable onto the drum to raise the lifting plate in the channel to thereby raise the panel thereon to the lifting arms of the lifter. The lifting plate its pivotally mounted to its slidable movement in the channel to pivot away from the channel for easier transfer of the panel from the lifting plate to the supporting arms of the lifter.

2 Claims, 4 Drawing Sheets

PANEL LIFTING APPARATUS

This application claims the benefit of U.S. Provisional Application No. 60/029,489 filed on Oct. 28, 1996.

BACKGROUND OF THE INVENTION

This invention relates to panel lifting apparatus and the like.

It is an object of the invention to provide a novel lifting attachment for lifting drywall panels and the like, from immediately adjacent the ground onto drywall lifter lifting arms having an initial elevated lifting position, for further lifting by the lifting arms of the lifter, by transferring the panel onto the arms.

It is another object of the invention to provide a novel lifting attachment for attachment to a drywall lifter having elevated lifting arms for elevating drywall panels from immediately adjacent the ground to the elevated lifting arms, for transfer onto the elevated lifting arms for further lifting with the lifting arms.

It is a further object of the invention to provide a novel lifting attachment for attachment to a dry wall lifter which can be collapsed against the lifter for storage.

It is another object of the invention to provide a novel lifting device for lifting drywall panels from immediately adjacent the ground.

It is a further object of the invention to provide a novel lifting attachment which can be detachably mounted to a drywall lifter having elevated lifting arms for lifting drywall panels from immediately adjacent the ground to the elvated lifting arms, and transferring the panel onto the elevated lifting arms, and operating the lifter for elevating the arms with the paenel thereon to a further height while the attachment remains attached to the lifter.

Further objects and advantages of the invention will become apparent as the description proceeds and when taken in conjunction with with the accompanying drawings wherein:

BRIEF DESCRIPTION OF PREFERRED EMBODIMENT

Briefly stated, the invention comprises a panel lift apparatus for attachment to a conventional drywall lifter and the like for raising a drywall panel, from immediately adjacent the ground to the lifting arms of th lifter, for transfer onto the lifting arms of the lifter; and wherein, the lifter may lift the lifting arms with the panel thereon to a further height while the attachment remains attached to the lifter.

The lift attachment has a main frame with a pivotally mounted upright channel member pivotally mounted to the main frame with the main frame detachably mounted to the drywall lifter. The main frame has a pair of V shaped mounting channels for mounting the main frame to the lifter, with a metal loop at the top for looping over the top of the drywall lifter frame. A L shaped lifting plate is slidably mounted to the upright channel member and is adapted to be slid down along the channel to immediately adjacent the ground and receive a drywall panel thereon, and may be raised by a cable along the channel member to the support arms of the lifter, where the lifting arms of the lifter may receive the a panel from the lifting plate and lift the panel to a further height. The channel member may be pivoted against the lifter for storage when not in use, and the lifter plate is pivotally mounted to pivot forward from the channel for easier shifting of the panel for the lifting plate to the lifting arms of the lifter.

Figure 1:
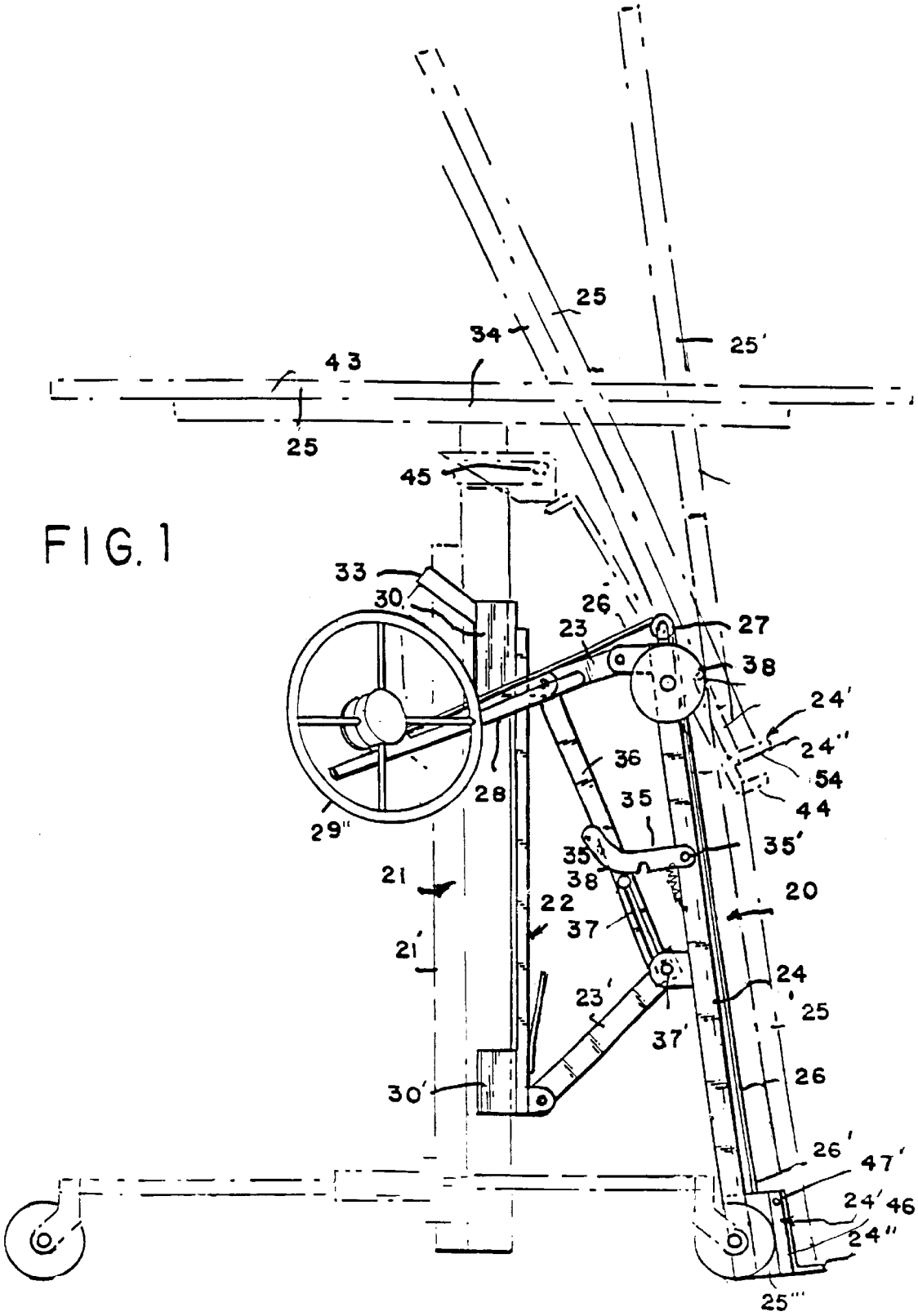
FIG. 1 is a side elevational view of the panel loader attachment shown operatively installed on a conventional dry wall lifter; and illustrating in solid lines, the position of the lifting plate of the attachment adjacent the ground for loading the drywall onto the plate, and illustrating the position of the lifting plate and drywall in phantom lines after having been lifted up to the support arms of the lifter, and illustrating in phantom lines the position of the drywall and after transferred onto the support arms, and the position of the of the support arms and drywall after the arms have been pivoted to horizontal position.

Referring more particularly to the drawings, in FIG. 1, the lifting attachment 20 is illustrated shown detachably mounted to a conventional drywall lifter 21. The attachment 20 has a main frame 22 with a pair of link members 23 and 23' pivotally mounting a channel member 24 to the main frame. The channel member 24 has a lifting plate 2 and the lifting plate 24' has a slidable projection 25''' slidable in the channel for guiding and supporting the lifting plate upward and downward along the channel by sliding upward and downward in the channel 24. Four rollers 47 are rotatably mounted to the projection 25''' and rotatably the projection 25 to enable it to roll along inside the channel 24.

The lifting plate has a lateral flange 24" which receives and supports a drywall panel 25 thereon, for raising and lowering the panel. The lifting plate 24' is raised and lowered by a cable 26 which has its one end 26' attached to the lifting plate 24'. A pulley 27 is rotatably mounted to the top of the channel 24, and a lateral arm 28 has one end fixed to the upper link 23 and extends rearward with a drum 29 rotatably mounted on the other end of the arm 28 and a wheel 29' fixed to the drum, The cable 26 has an intermediate portion running on the top of the pulley 27. Its other end is attached to the drum 29 so that manually rotating the wheel rotates the drum, which drum winds the cable 26 onto the drum raising the other end of the cable and plate 24' upward along the channel to raise the drywall panel upward along the channel, on the plate.

The main frame 22 has a pair of V shaped channels 30 and 30' fixed to an upright rod 32 and a metal loop 33 is fixed to the upper V chanel 30'. To install the attachment 20 to the lifter 21, the loop 33 is looped over the outer sleeve 21' of the lifter, with the V channels abutting against the outer sleeve 21' of the lifter, the outer sleeve has conventional telescoping sleeves therein with supporting arms 34 pivoted to the top innermost sleeve, so that the sleeves can be telescoped in the outer sleeve 21' to raise the supporting arms and a drywa panel, if placed thereon, upward.

The pair of link members 23 and 23' are each pivotally mounted at their one ends to the main frame 22 and pivotally mounted at their other ends to the channel member 24 in a generally parallel linkage at pivot points 23". A diagonal link plate 36 has its upper end pivotally mo unted to the main frame 22 coaxially with the link plate 23's pivotal mounting to the main frame. The lower end of the diagonal plate has an elongated slot 37, and the channel member 24 has a pin 37' fixed thereto, to which the lower link member 23' is pivotally mounted and the pin 37' is slidable in the slot 37. Consequently, when the channel member is pivoted clockwise away from the main frame 22 on plates 23 and 23', the pin 37' slides down in the slot 37 until it reaches the bottom of the slot, and then the operator will urge the plate 36 further downward, when viewed from FIG. 1 to urge the pin into the lateral notch 37" at the bottom of the slot, to lock the channel member 24 downward away from the main frame 22.

Figure 3:
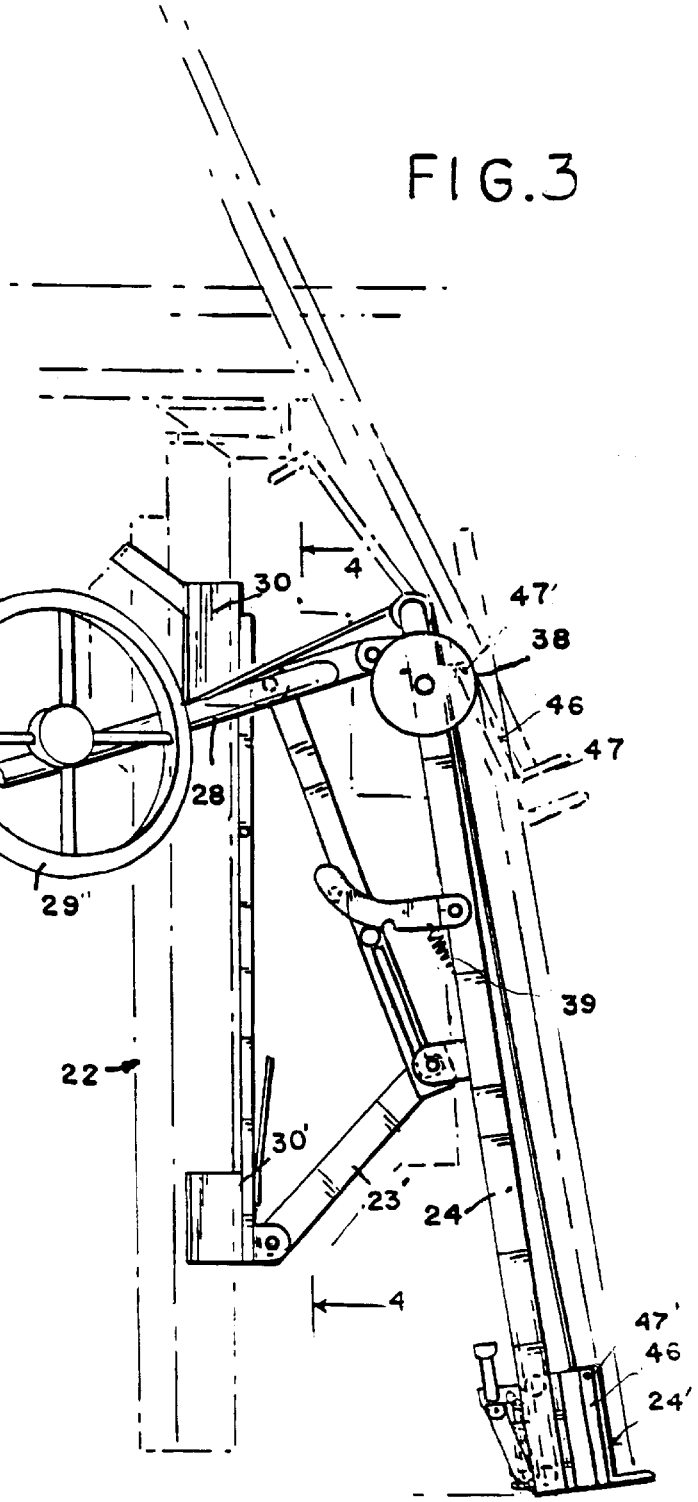
FIG. 3 is an enlarged fragmentary view of the panel lifting attachment similar to FIG. 1.
Figure 4:
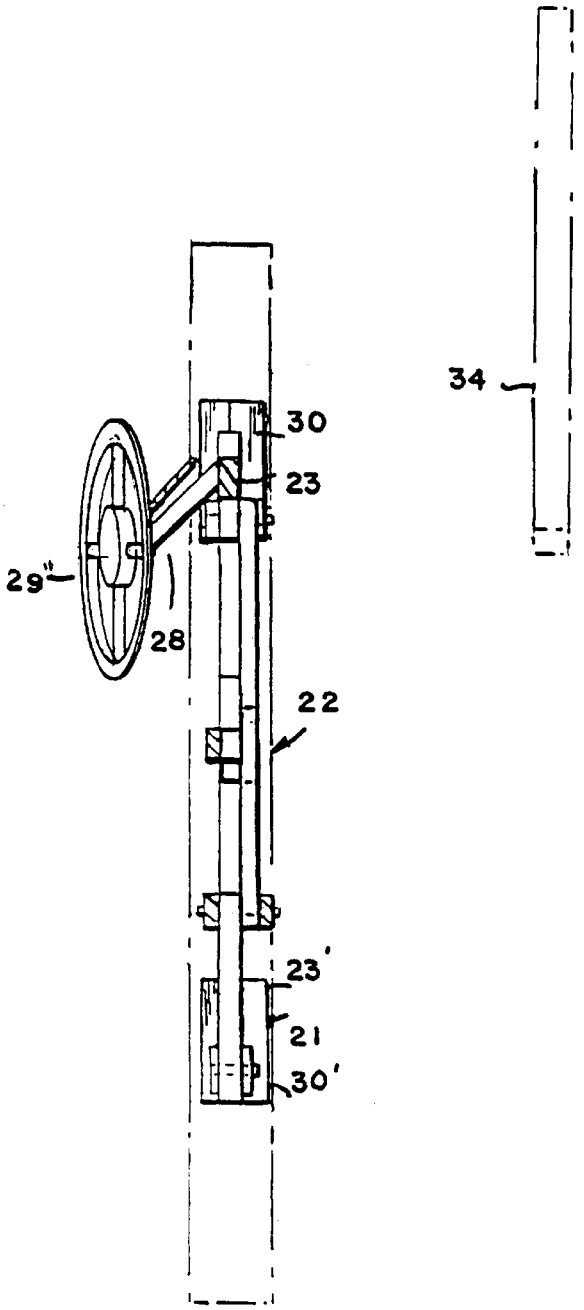
FIG. 4 is a cross-sectional view taken along line 4—4 of FIG. 1.
Figure 5:
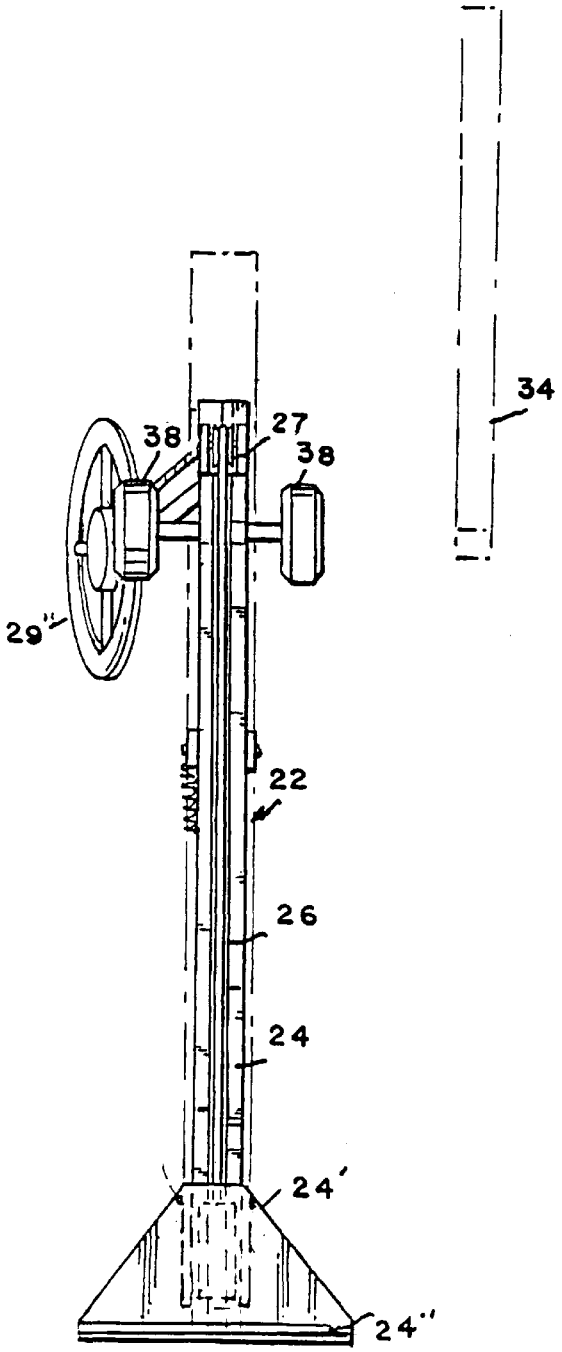
FIG. 5 is a front view of the panel lifting attachment.
Figure 6:
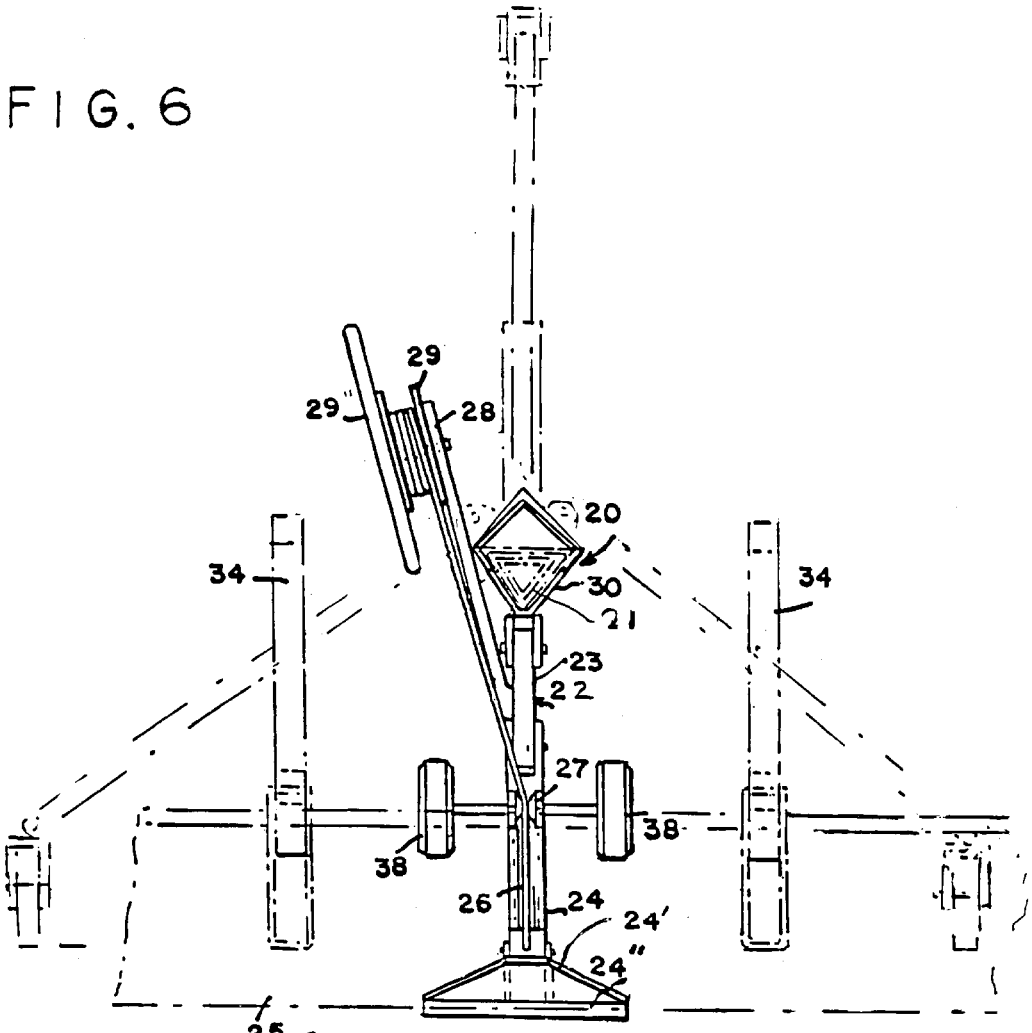
FIG. 6 is a top view of the panel lifting attachment.

The attachment 20 has a lever arm 35 pivotally mounted to the channel member 24 at its one end, and a spring 39 spring urges the the other end of the lever arm 35 downward against the projecting disc 40, fixed to the diagonal link plate 36 to urge the linkplate clockwise downward about its pivotal mounting to the frame 22 at at its upper end, so as to urge the lower end of the plate 36 down so that the pin 37' remains in the lateral upward notch 37" and thereby keeps the channel member locked in its position as shown in FIGS. 1 and 3, with the channel member 24 spaced away from the frame member 22.

Figure 2:
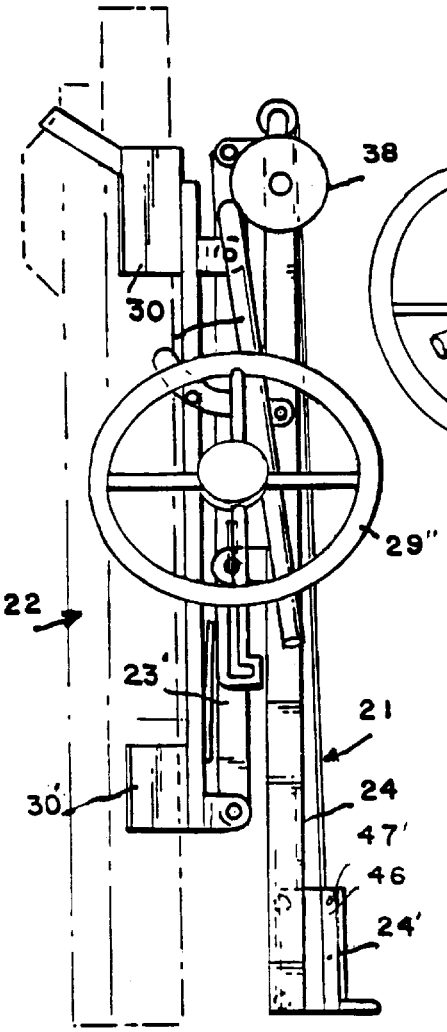
FIG. 2 is a side view of the panel loader or lifting attachment shown collapsed against the lifter for storage.

The attachment 20 may be pivoted into an operative position and locked in an operative position as shown in FIGS. 1 and 3, by pivoting the channel member 24 clockwise downward from its position in FIG. 2 to its position shown in FIG. 3, by the parallel linkage plates 30 and 30' pivoting clockwise downward. The pin 37' on the channel member 24 will slide downward in the slot 37 of plate 36. causing the plate 36 to pivot on its upper pivot to the main frame counterclockwise to its diagonal position, and the pin 37' will slide into the lateral notch 37" at the bottom of the slot to lock the channel member 24 and link plates 30 and 30' in their position as shown in FIGS. 1 and 3. The locking plate 35, being spring urged downward, counterclockwise, will engage the circular projection 40 on plate 36 and urge its lower end clockwise downward to hold the plate with the pin in the lateral notch to maintain the locked position.

The attachment 20 may be pivoted to a storage position on the lifter 21, as shown in FIG. 2, by lifting the locking plate or link 35 upward clockwise, pivoting it about its pin 35' on channel member 24 and sliding the notches end 37" of the plate 36 out of pin 37' on channel 24. The projection 35'" on the back of plate 35 engages linking plate 35 and also urges the plate upward out of the notched end. This enables the linking plate 36, which is pivotally mounted at its upper end 36' to rod 22, to pivot clockwise downward about pin 41 with its other end sliding downward along the pin 37' by the pin 37' sliding in the slot 37' in plate 36. The sliding of link 36 downward allows the links 23 and 23' to pivot upward about their pivot pins 41 and 41 to their position parallel to channel member 24, as shown in FIG. 2. with the channel member pivoted to a parallel position as shown in FIG. 2. A pin 42 may be fixed on rod 22 to receive the notched end end 35" of locking link 35 to lock the channel and links in the collapsed position adjacent the main rod 22, as shown in FIG. 2.

The lifting plate 24' has a pair of side flanges 46 and 46' which are fixed to the back of the olate 24' and extend upward along opposite sides of projection 25'" with their upper ends pivotally mounted to the sides of the projection 25'" on pins 47' to provide the pivotal mounting of the lifting plate to the projection and enable it to pivot from its position flush against the front of the projection, as shown in solids lines in FIGS. 1 and 3, counterclockwise away from the projection to its position shown in phantom lines 54 in FIGS. 1 and 3

OPERATION

The operation of the lifting attachment is as follows:

Once the attachment has been installed on the lifter 21, as shown in FIGS. 1–5, the channel member 24 will be pivoted on links 23 and 23' down to its operative position, as shown in FIGS. 1 and 3; and the locking plate 35 will be pivoted downward onto disc 40 with the notched end 37" of slot 37 of plate 36 receiving the pin 37' to place the attachment 20 in its operative position, with plate 35 spring urged downward on disc 40 to keep the notched end on pin 37'.

When it is desired to elevate a drywall panel to a height reachable only by telescoping the sleeves of the lifter to raise the lifting arms 34 of the lifter, with the drywall panel thereon, up to the height, and and since this height is beyond the height capable of being reached by the attachment 20; the operator will first place the drywall panel 25 on the bottom edge 24" or flange of the lifting plate 24', when the lifting plate has been lowered to the ground, as shown in solid lines in FIG. 1. The lifting plate 24' being adjacent the ground the drywall panel may be placed on its bottom edge 24" by raising the drywall panel only slightly.

The operator will then manually rotate the wheel 29" of the attachment thereby rotating the drum 29 which winds the cable 26 thereon to the drum, which raises the lifting plate 24' and the drywall panel 25, thereon, upward. The wheel 29" will be rotated to wind the cable 26 to raise the lifting plate and drywall panel to their position shown in phantom lines 41 in FIG. 1, with the drywall panel designated as 25'.

As the lifting plate 24', with the drywall panel 25 thereon, reaches the position shown in phantom lines 41, the drywall panel and the lifting plate, being frictionallly engaged to the bottom of the panel, may pivot counterclockwise outward to its position shown in phantom lines 43, by the lifting plate 24' pivoting on its pair of pins 47', which provide the pivotal mounting of the lifting plate 24' to the sliding projection 25'". The drywall panel 25, as it is being raised by the lifter plate will rest and roll up along a pair of wheels 38, rotatably mounted to the channel 24 with the wheels rotatably supporting the upper portion of the panel 25 initially. Since the drywall panel 25 rests on the wheels and rolls upward along the wheels at a slight angle, as more and more of the drywall panels rises above the wheels, the gravitational weight of the panel will tend to pivot the panel 25 and lifting plate counterclockwise toward the supporting arms 34 of the lifter 21, alone, to its position in phantom lines, without operator's assistance, although it may be provided. The panel's movemeent and its frictional engagement with the plates causes the plate pivotal movement on its pins 47'.

Further, since the drywall panel is tilted in that direction, it will cause the lifting plate to pivot counterclockwise to its position shown in phantom lines 43 in FIG. 1, on its pins 47'.

The supporting arms 34 of the lifter 21 will be, previous to the lifting of the drywall panel upward on the lifting plate, tilted to an angle as shown in phantom lines 41" in FIG. 1, so that when the panel 25 tilts or pivots or is tilted or is pivoted counterclockwise causing the lifting plate to also pivot about its pins, the panel will pivot about the wheels 38 against the tilted supporting arms 34 of the of the lifter. The supporting arms 34 will have conventional pivoting rod hooks 34', which may now be pivoted down to their lower position shown in phantom lines and designated by the numeral 44. The panel 25 will have been previously raised slightly above these hooks 34', when pivoted to their downward position 44, before the hooks are pivoted down to their lower position. This is so when the panel has been raised to its position 41 and the hooks have been then pivoted to their down position 44; the drum 29 of the wheel 29" to unwind the cable slightly, to lower the drywall panel onto the hooks 34'. Thereafter, the supporting arms 34 may be pivoted back counterclockwise, about their pivotal mounting 45 to the innermost sleeve of the lifter, to a horizontal position on the lifter 21, as shown in phantom lines 43"' in FIG. 1.

Thereafter, the lifter 21 may be operated conventionally to raise the telescoping sleeves of the lifter and thereby raise the supporting arms and the drywall panel thereon, upward therefrom to raise the drywall panel upward to a ceiling or upper wall surface for example, for installation of the drywall panel to the ceiling or upper wall surface. The slight lowering of the lifting plate 24' to cause the drywall panel 25 to lower onto and rest on the hooks of the supporting arms of the lifter thereby transfers the drywall panel from the attachment to the lifting arms of the lifter.

Thus, its will be seen that a novel attachment to a drywall lifter has been provided which enables a drywall panel to be elevated from immediately adjacent the ground to the lifting arms of the lifter, without the operator having to manually elevate the panel to the lifting arms; and thereafter, the lifter may be operated to raise the panel further on the supporting arms of the lifter.

A spring 38 is mounted to the main frame 22 and urges the the lower link plate clockwise outward, and thereby urges the channel member outward to facilitate the device being moved to its operative position and prevent the link plates and channel member from freezing it its storage position.

Figure 7:
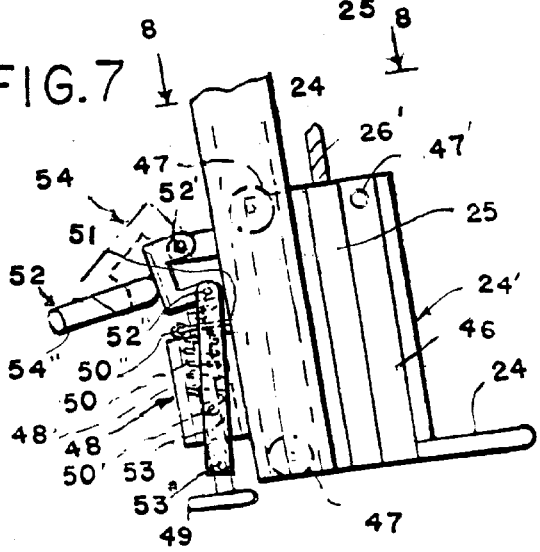
FIG. 7 is an enlarged fragmentary side view of the lower portion of the channel and the sliding lift in the channel.
Figure 8:
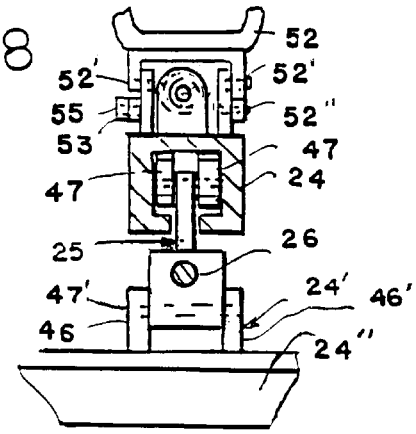
FIG. 8 is a cross sectional view taken along line 8—8 of FIG. 7.

A suitable stop 48 may be mounted to the bottom of channel member 24, as shown in FIGS. 7 and 8. The stop has a housing 48' fixed to the channel member 24 with a rod 49 slidably mounted in the housing and a spring 50 mounted coaxially over the rod, with one end 50' attached to the rod and the other end 50" attached to a plate 51 fixed to the channel member. The spring 50 is a compression spring so that when the rod is projected downward to engage the ground, the spring 50 acts to urge the rod back upward off the ground. The rod when engaged downward against the ground act to stop the channel from moving relative to the ground when operating the attachment.

A lever 52 is pivotally mounted to the channel member at pivot point 52'. The lever has a second pivot 52", and a link plate 53 has its upper end pivotally mounted ot the lever 52 at pivot point 52". The other end of rod 53 is pivotally mounted to the bottom portion of rod 49, at pivot point 53'.

To operate the stop 48, the lever 52 is pivoted counterclockwise from its position shown in phantom lines and designated by numeral 54 to its position shown in solid lines and designated by by numeral 54". The movement of the lever, through the link plate connection to the rod 49, urges the rod downward to its position against the ground to stop the channel member from movement relative to the ground. The lever 52 will be continued to pivot counterclockwise, when viewed from FIG. 7, after the rod has engaged the ground until the second pivot 52" has pivoted counterclockwise to the right of a line passing through the lever pivot 52', and the pivot 53' to lock the leer and rod downward. By manually pivoting the lever 52 clockwise backward the spring then is able to urge the rod back upward to its stored position when not in use.

It will be obvious that various changes and departures may be made to the invention without departing from the spirit and scope thereof, and accordingly, it is not intended that the invention be limited to that specifically described in the specification or as illustrated in the drawings, but only as set forth in the appended Claims wherein:

What is claimed is:

1. A panel lift apparatus for detachably mounting to a drywall lifter having supporting arms which may be pivoted to an angle for loading a drywall panel thereon and which has telescoping members beneath the arms for telescoping upward to raise the supporting arms upward and which has an upward extending frame, said apparatus comprising an upright frame for detachably mounting in parallel upright relation to the main frame of the lifter, a pivotally mounted channel member pivotally mounted to the apparatus upright frame and pivotable toward the apparatus for storage on the lifter and pivotable away from the apparatus main frame for operatively positioning the apparatus, a lifting plate having a projecting portion projecting in the channel member, said channel member having a slot receiving said projecting portion and enabling said projecting portion to slide upward and downward in said channel member with said lifting plate moving upward and downward outside the channel member, cable means for raising and lowering the lifting plate to thereby raise a panel thereon to the supporting arms of the lifter, said lifting plate being pivotally mounted to the projecting portion to pivot away from the channel member for easier transfer of the panel from the lifting plate to the supporting arms of the lifter.

2. A panel lift apparatus for detachably mounting to a drywall lifter having supporting arms which may be pivoted to an angle for loading a drywall panel thereon and which has a telescoping member beneath the arms for telescoping upward to raise the supporting arms upward and which has an upward extending frame, said apparatus comprising an upright main frame for detachably mounting to the main frame of the lifter, a movably mounted channel member movably mounted to the upright frame toward the main frame for storage on the lifter and movable away from the main frame for operatively positioning the apparatus, a lifting plate having a projecting portion projecting into the channel member, said channel member having a slot receiving said projecting portion and enabling said projecting portion to slide upward and downward in said channel member with said lifting plate moving upward and downward outside the channel member, cable means for raising and lowering the lifting plate to thereby raise panel thereon to the supporting arms of the lifter, said lifting plate being pivotally mounted to the projecting portion to pivot away from the channel member for easier transfer of the panel from the lifting plate to the supporting arms of the lifter.

* * * * *